US005499508A

United States Patent [19]

Arai et al.

[11] Patent Number: 5,499,508

[45] Date of Patent: Mar. 19, 1996

[54] AIR CONDITIONER

[75] Inventors: Yasuhiro Arai, Kanagawa; Tetsuo Sano, Shizuoka; Tetsuji Yamashita, Kanagawa; Takaki Iwanaga, Tokyo; Koichi Goto, Kanagawa, all of Japan

[73] Assignee: Kabushiki Kaisha Toshiba, Kanagawa, Japan

[21] Appl. No.: 220,092

[22] Filed: Mar. 30, 1994

[30] Foreign Application Priority Data

Mar. 30, 1993 [JP] Japan ..... 5-072193

[51] Int. Cl.[6] ..... F25B 1/00

[52] U.S. Cl. ..... 62/114; 62/184; 62/186; 62/174; 62/502

[58] Field of Search ..... 62/114, 174, 149, 62/228.4, 502, 228.3, 184, 186, 225, 230, 156, 131

[56] References Cited

U.S. PATENT DOCUMENTS

| | | | |
|---|---|---|---|
| 4,679,403 | 7/1987 | Yoshida et al. | 62/114 |
| 4,722,195 | 2/1988 | Suzuki et al. | 62/174 X |
| 5,058,390 | 10/1991 | Sindermann et al. | 62/228.4 X |
| 5,186,012 | 2/1993 | Czachorski et al. | 62/114 |

FOREIGN PATENT DOCUMENTS

| | | |
|---|---|---|
| 61-86537 | 5/1986 | Japan . |
| 62-52368 | 3/1987 | Japan . |
| 62-52369 | 3/1987 | Japan . |

*Primary Examiner*—Harry B. Tanner
*Attorney, Agent, or Firm*—Foley & Lardner

[57] ABSTRACT

An air conditioner employs a refrigerating cycle in which a non-azeotropic mixture of high and low boiling coolants is sealed. The ratio between the high and low boiling coolants of the coolant mixture changes according to a change in the opening of an electric expansion valve 7. A level sensor 19 is arranged in an accumulator 17 that accumulates the liquid phase of the coolant mixture. A value detected by the level sensor is used to calculate the ratio between the high and low boiling coolants actually circulating in the refrigerating cycle. According to the opening of the valve 7 or the ratio between the actual quantities of the high and low boiling coolants, basic operation parameters such as the operation frequency of a compressor 1 are changed. This results in stabilizing and optimizing the operation of the refrigerating cycle even if a cycle temperature or pressure is changed due to a change in the ratio between the high and low boiling coolants of the coolant mixture.

15 Claims, 6 Drawing Sheets

LARGE
QUANTITY OF ACCUMULATED HIGH BOILING COOLANT
SMALL
LARGE
SMALL
OPENING OF ELECTRIC EXPANSION VALVE

DISCHARGE TEMPERATURE
Td (℃)
120
117
110
100
103

FIG.5

| S CODE | FREQUENCY BEFORE CHANGE | FREQUENCY AFTER CHANGE |
|---|---|---|
| S3 | 10Hz | 10Hz |
| S4 | 16 | 15 |
| S5 | 20 | 18 |
| S6 | 28 | 25 |
| S7 | 36 | 32 |
| S8 | 44 | 40 |
| S9 | 57 | 52 |
| S10 | 62 | 55 |
| S11 | 75 | 67 |
| S12 | 84 | 75 |
| S13 | 92 | 80 |
| S14 | 105 | 90 |
| S15 | 115 | 100 |

FIG.6

| S CODE | V/F BEFORE CHANGE | V/F AFTER CHANGE |
|---|---|---|
| S3 | 30V/10Hz | 40V/10Hz |
| S4 | 40/16 | 50/15 |
| S5 | 50/20 | 60/18 |
| S6 | 60/28 | 70/25 |
| S7 | 70/36 | 80/32 |
| S8 | 90/44 | 100/40 |
| S9 | 110/57 | 120/52 |
| S10 | 120/62 | 130/55 |
| S11 | 140/75 | 140/67 |
| S12 | 150/84 | 150/75 |
| S13 | 160/92 | 160/80 |
| S14 | 180/105 | 180/90 |
| S15 | 200/115 | 200/100 |

FIG.7

| MODE OF INDOOR FAN | REVOLUTION SPEED BEFORE CHANGE | REVOLUTION SPEED AFTER CHANGE |
|---|---|---|
| WEAKEST | 750 rpm | 800 rpm |
| VERY WEAK | 800 | 900 |
| WEAK | 1000 | 1100 |
| STRONG | 1200 | 1200 |

FIG.8

| MODE OF OUTDOOR FAN | REVOLUTION SPEED BEFORE CHANGE | REVOLUTION SPEED AFTER CHANGE |
|---|---|---|
| WEAKEST | 300 rpm | 350 rpm |
| VERY WEAK | 400 | 450 |
| WEAK | 500 | 550 |
| STRONG | 600 | 600 |

FIG.9

| MODE OF INDOOR FAN | LOVER POSITION BEFORE CHANGE | LOUVER POSITION AFTER CHANGE |
|---|---|---|
| WEAKEST | 90° VERTICAL | 90 °VERTICAL |
| VERY WEAK | 60 | 45 |
| WEAK | 30 | 20 |
| STRONG | 0° HORIZONTAL | 0° HORIZONTAL |

FIG.10

| OPERATION MODE | SUPERHEAT BEFORE CHANGE | SUPERHEAT AFTER CHANGE |
|---|---|---|
| COOLING | 3 ℃ | 1 ℃ |
| HEATING | 5 ℃ | 2 ℃ |
| VALVE OPENING FOR DEFROSTING | 160 PULSES CONSTANT | 200 PULSES CONSTANT |

FIG.11

| DISCHARGE TEMPERATURE MODE | SET DISCHARGE TEMPERATURE BEFORE CHANGE | SET DISCHARGE TEMPERATURE AFTER CHANGE |
|---|---|---|
| 1ST STEP | 100 ℃ | 90 ℃ |
| 2ND STEP | 110 ℃ | 100 ℃ |
| 3RD STEP | 120 ℃ | 110 ℃ |

FIG.12

| INDOOR HEAT EXCHANGER TEMPERATURE MODE | SET HEAT EXCHANGER TEMPERATURE BEFORE CHANGE | SET HEAT EXCHANGER TEMPERATURE AFTER CHANGE |
|---|---|---|
| 1ST STEP | 50 ℃ | 46 ℃ |
| 2ND STEP | 53 ℃ | 49 ℃ |
| 3RD STEP | 56 ℃ | 52 ℃ |

FIG.13

| COMPRESSOR CURRENT MODE | SET CURRENT BEFORE CHANGE | SET CURRENT AFTER CHANGE |
|---|---|---|
| 1ST STEP | 13A | 14A |
| 2ND STEP | 14A | 15A |
| 3RD STEP | 15A | 16A |

AIR CONDITIONER

BACKGROUND OF THE INVENTION

1. Field of the Invention

The present invention relates to an air conditioner with a refrigerating cycle employing a non-azeotropic mixture of high and low boiling coolants, and particularly, to optimizing the operation of the refrigerating cycle.

2. Description of the Prior Art

Heat pump air conditioners employ the atmosphere as a heat source for achieving heating and cooling operations. A refrigerating cycle employed by the heat pump air conditioners essentially involves a compressor for discharging a high-temperature high-pressure gaseous coolant, a four-way valve for changing the direction of the coolant according to heating and cooling operations, an outdoor heat exchanger serving as an evaporator during the heating operation and as a condenser during the cooling operation, a throttle mechanism such as an expansion valve to reduce the pressure of the coolant, and an indoor heat exchanger serving as a condenser during the heating operation and as an evaporator during the cooling operation.

These components are arranged in outdoor and indoor units. The outdoor unit may accommodate the compressor, an inverter to change the operation frequency of the compressor, the throttle mechanism, the four-way valve, the outdoor heat exchanger, and an outdoor fan. The indoor unit may accommodate the indoor heat exchanger and an indoor fan.

During the heating operation, the coolant flows through the outdoor heat exchanger to pump up heat from the atmosphere and through the indoor heat exchanger to discharge the heat into an atmosphere in a room. During the cooling operation, the coolant flows through the indoor heat exchanger to pump up heat from the room atmosphere and through the outdoor heat exchanger to abandon the heat into the atmosphere.

The performance of the air conditioner is dependent on the capacities of the outdoor and indoor heat exchangers. To meet present requirements of compactness and high performance, efficient small-sized heat exchangers and low-noise fans are being developed. Some heat exchangers employ small diameter coolant pipes to reduce the size of their indoor units and improve the efficiency thereof. The outdoor units are also required to be compact. It is not so successful as for the indoor units to reduce the size of the outdoor units due to the problem of frosting during a heating operation. Techniques applicable to the indoor heat exchangers such as forming slits on heat radiation fins of indoor heat exchangers and arranging the indoor heat exchangers In three or more stages are not applicable to the outdoor heat exchangers due to the problem of frosting.

In view of protection of global environments such as the ozone layer and prevention of global warming, the air conditioners are required to employ replacements of fluorocarbon-based coolant R22. The replacements are mostly non-azeotropic mixtures having similar cycle temperature and pressure as R22. The non-azeotropic mixtures are usually composed of high and low boiling coolants and show a large temperature gradient between gas and liquid phases. Accordingly, the non-azeotropic mixtures have poor heat transfer efficiency.

During the heating operation to pump up heat from the atmosphere, the non-azeotropic mixtures may freeze at an inlet of the outdoor heat exchanger. An effective temperature difference between an ambient temperature and the evaporation temperature of the mixtures in the outdoor heat exchanger is small to lower the heating capacity of the outdoor heat exchanger if the ambient temperature is low. During the cooling operation, the mixtures may freeze around the inlet of the indoor heat exchanger if the ambient temperature is low, to deteriorate the cooling capacity of the indoor heat exchanger.

To improve the air-conditioning capacity, some refrigerating cycles change the ratio between the high and low boiling coolants of the non-azeotropic mixture. This technique accumulates a liquid phase portion of the high boiling coolant in a tank, to increase the ratio of the high-performance low boiling coolant to the high boiling coolant.

After the ratio between the high and low boiling coolants is changed, the basic control conditions of the air conditioner such as the operation frequency of the compressor are usually unchanged. This results in destabilizing the operation of the refrigerating cycle because the change in the ratio between the high and low boiling coolants changes the cycle temperature and pressure of the coolant mixture.

SUMMARY OF THE INVENTION

An object of the present invention is to stabilize the operation of a refrigerating cycle even if the ratio of a high boiling coolant to a low boiling coolant of a non-azeotropic mixture changes.

In order to accomplish the object, the present invention provides a refrigerating cycle involving a compressor, an outdoor heat exchanger, an indoor heat exchanger, a throttle mechanism, and a non-azeotropic mixture of high and low boiling coolants sealed in the refrigerating cycle. The refrigerating cycle is provided with a controller for changing basic operation parameters according to a change in operating conditions that will cause a change in the ratio between the high and low boiling coolants. The refrigerating cycle is also provided with a detector for detecting the ratio between the high and low boiling coolants, and a controller for changing basic operation parameters according to a value detected by the detector.

This arrangement changes the basic operation parameters of the air conditioner according to a change in operating conditions that will cause a change in the ratio between the high and low boiling coolants, to stabilize and optimize the operation of the refrigerating cycle. When the ratio is changed, the detector detects the change, and the basic operation parameters of the air conditioner are changed accordingly, to thereby stabilize and optimize the operation of the refrigerating cycle.

These and other objects, features and advantages of the present invention will be more apparent from the following detailed description of preferred embodiments in conjunction with the accompanying drawings.

BRIEF DESCRIPTION OF THE DRAWINGS

FIG. 5 is a table showing the S codes of an inverter determined according to air-conditioning load and the corresponding basic operation frequencies of a compressor before and after a change, applicable to any one of the refrigerating cycles of FIGS. 1 and 3;

FIG. 6 is a table showing the S codes of the inverter determined according to air-conditioning load and the corresponding basic voltage/frequency (V/F) values of the compressor before and after a change, applicable to any one of the refrigerating cycles of FIGS. 1 and 3;

FIG. 7 is a table showing the operation modes of an indoor fan and the corresponding basic revolution speeds of the indoor fan before and after a change, applicable to any one of the refrigerating cycles of FIGS. 1 and 3;

FIG. 8 is a table showing the operation modes of an outdoor fan and the corresponding basic revolution speeds of the outdoor fan before and after a change, applicable to any one of the refrigerating cycles of FIGS. 1 and 3;

FIG. 9 is a table showing the operation modes of the indoor fan and the corresponding basic positions of an indoor louver before and after a change during a heating operation, applicable to any one of the refrigerating cycles of FIGS. 1 and 3;

FIG. 10 is a table showing the operation modes of the air conditioner and the corresponding basic degrees of superheat of the electric expansion valve before and after a change, applicable to any one of the refrigerating cycles of FIGS. 1 and 3;

FIG. 11 is a table showing the discharge temperature modes of the compressor and the corresponding set discharge temperatures thereof before and after a change, applicable to any one of the refrigerating cycles of FIGS. 1 and 3;

FIG. 12 is a table showing the temperature modes of an indoor heat exchanger and the corresponding set temperatures thereof before and after a change, applicable to any one of the refrigerating cycles of FIGS. 1 and 3; and FIG. 13 is a table showing the current modes of the compressor and the corresponding set currents thereof before and after a change, applicable to any one of the refrigerating cycles of FIGS. 1 and 3.

DETAILED DESCRIPTION OF THE EMBODIMENTS

Figure 1:
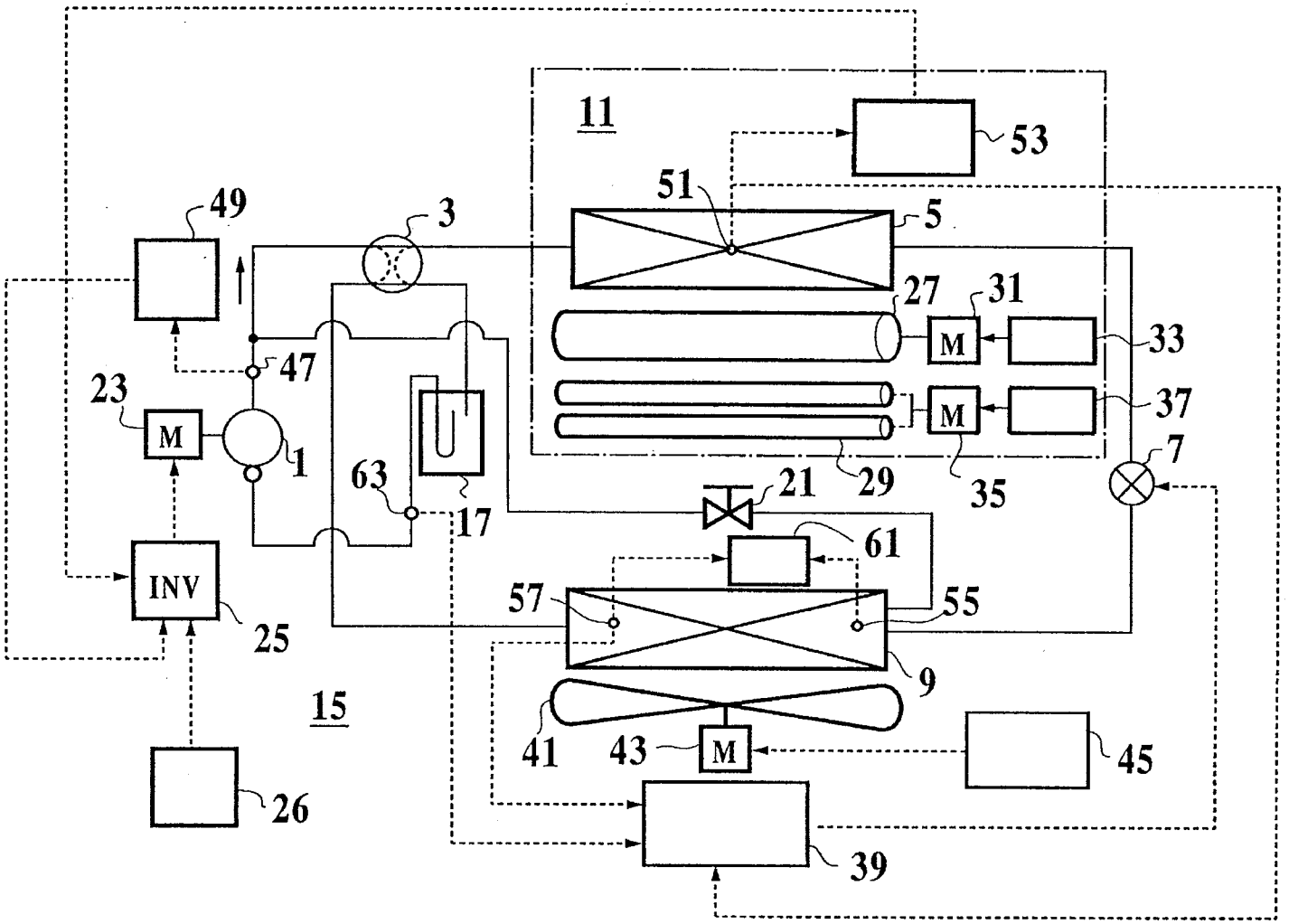
FIG. 1 shows a refrigerating cycle of a heat pump air conditioner according to an embodiment of the present invention.

FIG. 1 shows a refrigerating cycle of a heat pump air conditioner according to an embodiment of the present invention.

The refrigerating cycle employs a non-azeotropic coolant mixture whose cycle temperature and pressure are similar to those of R22. The coolant mixture is originally composed of 30% R32 as a low boiling coolant and 70% R134a as a high boiling coolant.

The refrigerating cycle essentially includes a compressor 1 for discharging the coolant mixture in the form of a high-temperature high-pressure gas, a four-way valve 3 for supplying the coolant mixture along continuous lines during a heating operation and along dotted lines during a cooling operation, an indoor heat exchanger 5 serving as a condenser during the heating operation and as an evaporator during the cooling operation, an electric expansion valve 7 serving as a throttle mechanism for reducing the pressure of the coolant mixture, and an outdoor heat exchanger 9 serving as an evaporator during the heating operation and as a condenser during the cooling operation. The indoor heat exchanger 5 is received in an indoor unit 11, and the other components are received in an outdoor unit 15.

An accumulator 17 is arranged between an inlet of the compressor 1 and the four-way valve 3, to separate the gaseous and liquid phases of the coolant mixture from each other and accumulate the liquid phase. In this example, the liquid phase of the high boiling coolant R134a is mostly accumulated in the accumulator 17. As the contraction of the valve 7 becomes smaller, i.e., as the opening of the valve 7 becomes larger, the quantity of the high boiling coolant R134a in the accumulator 17 becomes larger.

Figure 2:
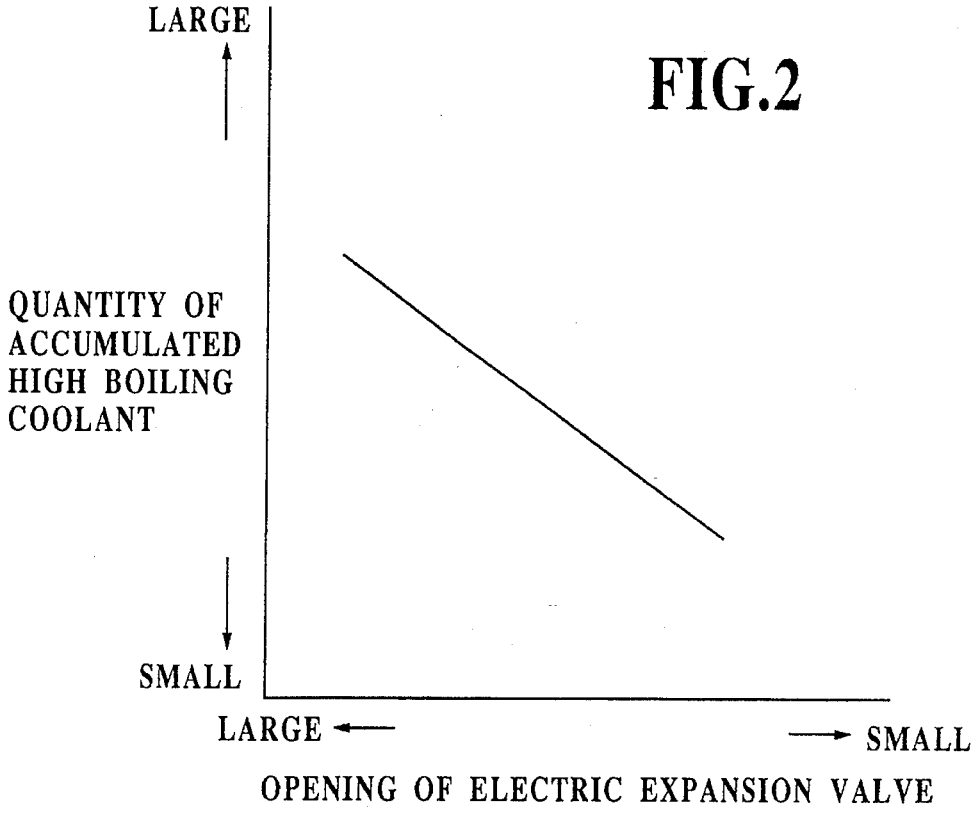
FIG. 2 is a chart showing a relationship between the opening of an electric expansion valve and the quantity of a high boiling coolant accumulated in an accumulator according to the embodiment of FIG. 1.

FIG. 2 shows a relationship between the opening of the valve 7 and the quantity of the high boiling coolant R134a accumulated in the accumulator 17. The smaller the contraction of the valve 7, 1.e., the larger the opening of the valve 7, the larger the quantity of the high boiling coolant R134a accumulated in the accumulator 17.

A defrosting two-way valve 21 is arranged between an outlet of the compressor 1 and an inlet during the heating operation of the outdoor heat exchanger 9.

The compressor 1 is driven by a motor 23 and an inverter 25, which is controlled by a compressor controller 26. The ratio between the high and low boiling coolants of the coolant mixture changes depending on the contraction of the valve 7. Relationships between changes in the opening of the valve 7 and the coolant ratios are studied in advance, and according to the studied relationships and an actual opening of the valve 7, the controller 26 controls the basic operation parameters such as the frequency or voltage/frequency (V/F) of the compressor 1.

Figure 3:
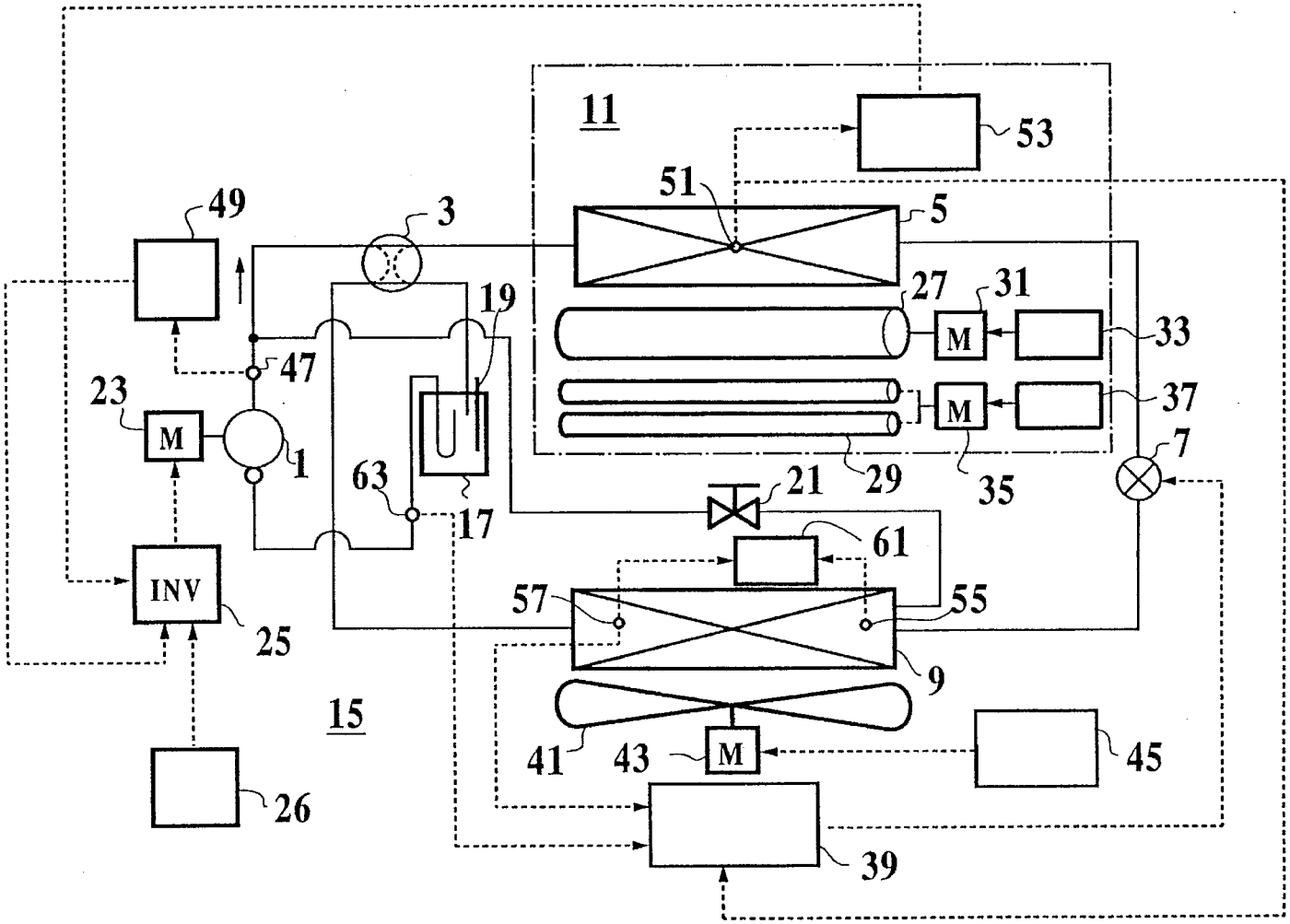
FIG. 3 shows a refrigerating cycle according to a modification of the embodiment of FIG. 1.

FIG. 3 shows a modification of the refrigerating cycle of FIG. 1. This modification employs a level sensor 19 to detect the ratio between the high and low boiling coolants of the coolant mixture. The level sensor 19 detects the level of the liquid phase of, mostly, the high boiling coolant accumulated in the accumulator 17. According to the level, the ratio between the high and low boiling coolants of the coolant mixture actually circulating in the refrigerating cycle is calculated.

In FIG. 3, the controller 26 controls the basic operation frequency or voltage/frequency (V/F) of the compressor 1 according to a value detected by the level sensor 19. The other parts of FIG. 3 are the same as those of FIG. 1.

The indoor unit 11 accommodates an indoor fan 27 and an indoor louver 29. Air that has exchanged heat with the coolant mixture in the indoor heat exchanger 5 is fanned by the fan 27 and guided by the louver 29 into a room. The fan 27 is driven by a motor 31 and a controller 33. The louver 29 is driven by a motor 35 and a controller 37.

The controller 33 controls the basic revolution speed of the fan 27 according to the opening of the valve 7 of FIG. 1 or the ratio between the actually circulating high and low boiling coolants calculated from a value detected by the level sensor 19 of FIG. 3. Similarly, the controller 37 controls the basic position of the louver 29 according to the opening of the valve 7 or the ratio between the coolants.

The outdoor unit 15 accommodates an outdoor fan 41 for sending the atmosphere to the outdoor heat exchanger 9 so that the coolant and atmosphere may exchange heat. The fan 41 is driven by a motor 43 and a controller 45. The controller 45 controls the basic revolution speed of the fan 41 according to the opening of the valve 7 of FIG. 1 or the ratio between the actually circulating high and low boiling coolants calculated from a value detected by the level sensor 19 of FIG. 3.

A sensor 47 is arranged at the outlet of the compressor 1, to detect the temperature of a discharge gas from the compressor 1. A detection signal of the temperature sensor 47 as well as a detection signal of the level sensor 19 of the accumulator 17 are provided to a controller 49. The controller 49 controls set temperatures used for the discharge temperature release control of the compressor 1, according to the opening of the valve 7 of FIG. 1 or the ratio between the actually circulating high and low boiling coolants calculated from a value detected by the level sensor 19 of FIG. 3. According to the set temperatures, the inverter 25 drives the compressor 1.

When the driving frequency of the compressor 1 is a constant value, the discharge set temperature control is carried out by adjusting the electric expansion valve 7.

Figure 4:
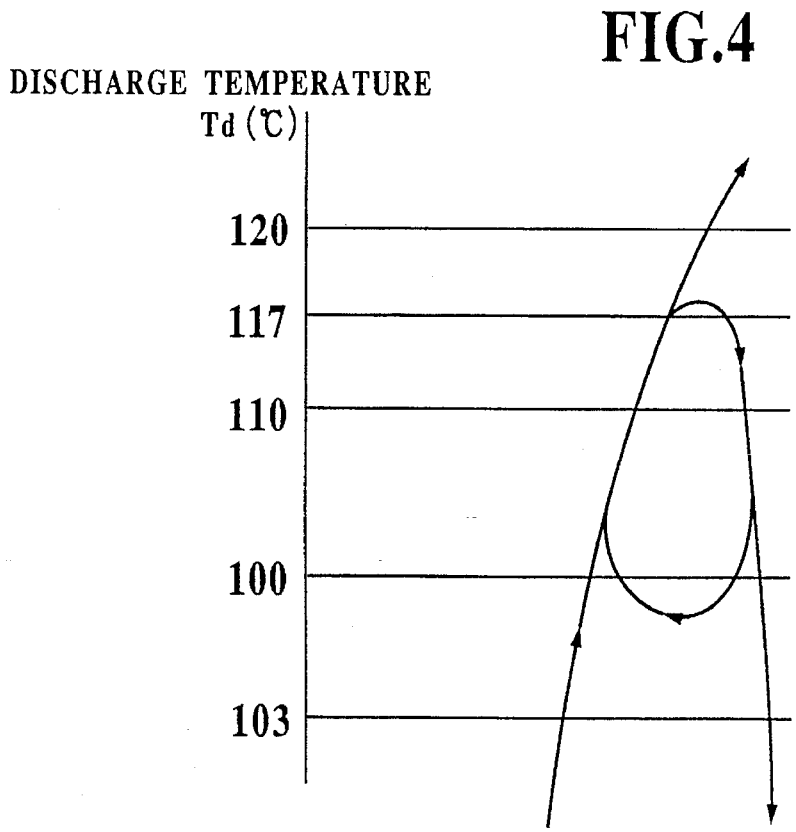
FIG. 4 is a chart showing discharge temperature release control in the refrigerating cycle of FIG. 1.

FIG. 4 shows the discharge temperature release control. For example, there are three set temperatures 100, 110, and 120 degrees centigrade. When the discharge temperature Td of the compressor 1 exceeds 100 degrees centigrade and even 110 degrees centigrade, the operation frequency of the compressor 1 is lowered to decrease the discharge temperature Td below 100 degrees centigrade and return the compressor 1 to a normal operation. If the discharge temperature Td exceeds 110 degrees centigrade and even 120 degrees centigrade, the compressor 1 is stopped.

The indoor heat exchanger 5 has a sensor 51 to detect the temperature of the indoor heat exchanger 5 and a controller 53 to receive a detection signal from the sensor 51. The controller 53 controls set temperatures used for the temperature release control of the indoor heat exchanger 5, according to the opening of the valve 7 of FIG. 1 or the ratio between the actually circulating high and low boiling coolants calculated from a value detected by the level sensor 19 of FIG. 3. According to the set temperatures, the inverter 25 drives the compressor 1. This control is carried out similar to the discharge temperature release control. Namely, it may employ three set temperatures to control the compressor 1 such that the temperature of the indoor heat exchanger 5 is kept below a specified temperature during the heating operation.

Current release control is carried out to keep a current for driving the compressor 1 below a specified value. The controller 26 controls a basic set current according to the opening of the valve 7 of FIG. 1 or the ratio between the actually circulating high and low boiling coolants calculated from a value detected by the level sensor 19 of FIG. 3.

An inlet temperature sensor 55 and an outlet temperature sensor 57 are arranged at opposite ends of the outdoor heat exchanger 9. Detection signals from these sensors 55 and 57 are supplied to a defrosting temperature controller 61. The controller 61 controls set temperatures to start and end a defrosting operation according to the opening of the valve 7 of FIG. 1 or the ratio between the actually circulating high and low boiling coolants calculated according to a value detected by the level sensor 19 of FIG. 3.

A compressor inlet temperature sensor 63 is arranged between the compressor 1 and the accumulator 17. Detection signals from the sensors 63, 57, and 51 are supplied to a controller 39 for controlling the opening of the valve 7. During the heating operation, the controller 39 controls the valve 7 so that the coolant mixture that evaporates may have a set degree of superheat corresponding to a difference between the compressor intake temperature and the outdoor heat exchanger outlet temperature. During the cooling operation, the controller 39 controls the valve 7 so that the coolant mixture that evaporates may have a set degree of superheat corresponding to a difference between the compressor intake temperature and the indoor heat exchanger temperature. The set degree of superheat is controlled by the controller 39 according to the opening of the valve 7 of FIG. 1 or the ratio between the actually circulating high and low boiling coolants calculated from a value detected by the level sensor 19 of FIG. 3.

The heating operation of the refrigerating cycle will be explained.

The compressor 1 in the outdoor unit 15 discharges the high-temperature high-pressure gaseous coolant mixture, which is guided to the indoor unit 11 through the four-way valve 3. While the coolant mixture is flowing through the indoor heat exchanger 5, the fan 27 sends indoor air toward the heat exchanger 5. The coolant mixture discharges heat into the air and is condensed. The condensed coolant mixture is returned to the outdoor unit 15 and is throttled by the valve 7. Namely, the valve 7 drops the pressure of the condensed coolant mixture to obtain the set degree of superheat corresponding to a difference between the intake temperature of the compressor 1 detected by the temperature sensor 63 and the outlet temperature of the outdoor heat exchanger 9 detected by the temperature sensor 57. The outdoor fan 41 sends the atmosphere toward the outdoor heat exchanger 9 so that the pressure-reduced coolant mixture exchanges heat with the atmosphere. This completes an evaporation process. The coolant mixture absorbs heat in the outdoor heat exchanger 9 from the atmosphere and evaporates into a low-pressure coolant mixture, which is completely separated into gas and liquid phases in the accumulator 17. Thereafter, the compressor 1 discharges the high-temperature high-pressure coolant mixture, to end a cycle of the heating operation.

The liquid accumulated in the accumulator 17 is mostly of the high boiling coolant R134a. The smaller the contraction of the valve 7, i.e., the larger the opening of the valve 7, the larger the quantity of the high boiling coolant R134a accumulated in the accumulator 17. When the liquid phase of the coolant mixture is accumulated in the accumulator 17, the quantity of the coolant mixture circulating through the refrigerating cycle differs from an initial one. Namely, the ratio between the high and low boiling coolants differs from an initial one.

Accordingly, the ratio between the actually circulating high and low boiling coolants of the coolant mixture is calculated according to the opening of the valve 7 of FIG. 1, or the level of the liquid coolant mixture accumulated in the accumulator 17 is detected by the level sensor 19 of FIG. 3, and according to the ratio or the level, the basic operation parameters are controlled.

The control of the basic operation parameters will be explained in detail. The basic operation parameters are changed when the opening of the valve 7 exceeds a specified value in the embodiment of FIG. 1, or when a value detected by the level sensor 19 exceeds a specified value in the embodiment of FIG. 3. In the latter case, the ratio of the high-performance low boiling coolant to the high boiling coolant in the actually circulating coolant mixture increases.

(1) Changing the basic operation patterns of the compressor 1

FIG. 5 is a table showing the S codes of the inverter 25 that are dependent on air-conditioning load and the corresponding basic operation frequencies of the compressor 1 before and after a change. When the quantity of the high-performance low boiling coolant increases relative to the quantity of the high boiling coolant, the controller 26 lowers the operation frequency of the compressor 1 for each S code except the code S3 for the lowest frequency, thereby reducing an input to the compressor 1 and saving energy.

(2) Changing the basic voltage/frequency (V/F) of the compressor 1

FIG. 6 is a table showing the S codes of the inverter 25 that are dependent on air-conditioning load and the corresponding basic V/F values of the compressor 1 before and after a change. When the quantity of the high-performance low boiling coolant increases relative to the quantity of the high boiling coolant, the air-conditioning load becomes larger, and therefore, the torque of the motor must be increased. Accordingly, the controller 26 increases the V/F values for each of the S codes, thereby reducing an input to the compressor 1 and saving energy.

(3) Changing the basic air quantity of the indoor fan 27

FIG. 7 is a table showing the operation modes of the indoor fan 27 and the corresponding basic revolution speeds of the fan 27 before and after a change. When the quantity of the high-performance low boiling coolant increases relative to the quantity of the high boiling coolant, a difference between the pressures of the coolant mixture at the outlet and inlet of the compressor 1 increases. Accordingly, the motor 31 and controller 33 increase the revolution speed of the indoor fan 27 for each operation mode except the strong wind mode that may cause noise, thereby decreasing the high pressure of the coolant mixture at the outlet of the compressor 1 during the heating operation in which the indoor heat exchanger 5 serves as a condenser, and increasing the low pressure of the coolant mixture at the inlet of the compressor 1 during the cooling operation in which the indoor heat exchanger 5 serves as an evaporator. This results in reducing the pressure difference of the coolant mixture between the inlet and outlet of the compressor 1, saving energy, and improving reliability.

(4) Changing the basic air quantity of the outdoor fan 41

FIG. 8 is a table showing the operation modes of the outdoor fan 41 and the corresponding basic revolution speeds of the outdoor fan 41 before and after a change. When the quantity of the high-performance low boiling coolant increases relative to the quantity of the high boiling coolant, the pressure difference of the coolant mixture between the inlet and outlet of the compressor 1 increases. Accordingly, the motor 43 and controller 45 increase the revolution speed of the outdoor fan 41 for each operation mode except the strong wind mode that may cause noise, thereby decreasing the pressure difference, saving energy, and improving reliability, similar to the indoor fan 27.

(5) Changing the basic position of the indoor louver 29

FIG. 9 is a table showing the operation modes of the indoor fan 27 and the corresponding basic positions of the indoor louver 29 before and after a change during the heating operation. When the quantity of the high-performance low boiling coolant increases relative to the quantity of the high boiling coolant, the condensation temperature of the coolant mixture drops if a temperature on the high pressure side is unchanged. Accordingly, the motor 35 and controller 37 move the louver 29 to a horizontal position under a very weak or a weak wind mode, to prevent air with a relatively low temperature from being sent toward a user, thereby improving reliability and comfort.

(6) Changing the basic opening of the electric expansion valve 7

FIG. 10 is a table showing the operation modes of the air conditioner and the corresponding basic degrees of superheat due to the valve 7 before and after a change during the cooling and heating operations. When the quantity of the high-performance low boiling coolant increases relative to the quantity of the high boiling coolant, the pressure difference of the coolant mixture between the inlet and outlet of the compressor 1 increases. Accordingly, the controller 39 reduces the contraction of, i.e., increases the opening of the valve 7 for each operation mode, thereby decreasing the set degree of superheat, saving energy, and Improving reliability. The set degree of superheat may be adjusted according to fuzzy control or PID control.

(7) Changing a set temperature used for the discharge temperature release control of the compressor 1

FIG. 11 is a table showing discharge temperature modes and the corresponding basic discharge temperatures of the compressor 1 detected by the temperature sensor 47 before and after a change. When the quantity of the high-performance low boiling coolant increases relative to the quantity of the high boiling coolant, the discharge temperature easily increases. Accordingly, the controller 49 and inverter 25 drop a set temperature for the discharge temperature release control of the compressor 1. This results in saving energy and improving reliability.

(8) Changing a set temperature used for the temperature release control of the indoor heat exchanger 5

FIG. 12 is a table showing indoor heat exchanger temperature modes and the corresponding set temperatures of the indoor heat exchanger 5 detected by the temperature sensor 51 before and after a change during the heating operation. When the quantity of the high-performance low boiling coolant increases relative to the quantity of the high boiling coolant, the condensation pressure of the coolant mixture easily increases even if the condensation temperature thereof is low. Accordingly, the controller 53 and inverter 25 decrease a set temperature used for the indoor heat exchanger release control and drive the compressor 1. This results in saving energy and improving reliability.

(9) Changing a basic set current used for the current release control of the compressor 1

FIG. 13 is a table showing compressor current modes applied to the compressor 1 and the corresponding basic set currents of the compressor 1 before and after a change. When the quantity of the high-performance low boiling coolant increases relative to the quantity of the high boiling coolant, air-conditioning load easily increases. Accordingly, the controller 26 increases a set current value used for the compressor current release control to drive the compressor 1. This results in improving the heating capacity of the air conditioner.

(10) Changing basic set values of the temperature sensors

As an example, a defrosting operation during the heating operation will be explained. Frost is detected according to an inlet temperature of the outdoor heat exchanger 9 detected by the temperature sensor 55. Defrosting is carried out by opening the defrosting two-way valve 21 to flow the hot coolant gas from the outlet of the compressor 1 to the outdoor heat exchanger 9. The end of the defrosting is detected according to an inlet temperature of the outdoor heat exchanger 9 detected by the temperature sensor 55 or an outlet temperature thereof detected by the temperature sensor 57. The set temperatures of the temperature sensors 55, 57, and 59 are changed to carry out an optimum defrosting operation according to the ratio between the high and low boiling coolants of the actually circulating coolant mixture.

It is possible to carry out the detection of the frost by an outdoor temperature sensor with the outdoor heat exchanger inlet temperature sensor 55.

The defrosting may be carried out by reversing the four-way valve 3, or by opening the electric expansion valve 7.

During the cooling operation, there will be a possibility of the indoor heat exchanger 5 freezing if an ambient temperature is low to decrease a condensation temperature as well as an evaporation temperature. This possibility is detected according to the temperature of the indoor heat exchanger 5. Such freezing may be prevented by decreasing the operation frequency of the compressor 1, or by reducing the contraction of the valve 7. The set temperatures of the temperature sensors are changed according to the ratio between the high and low boiling coolants of the actually circulating coolant mixture, to most effectively prevent the freezing of the heat exchanger.

In this way, the high boiling coolant of the non-azeotropic coolant mixture circulating through the refrigerating cycle is accumulated in the accumulator 17 during the operation of the air conditioner. When the quantity of the high-performance low boiling coolant increases relative to the quantity of the high boiling coolant, the basic operation parameters are changed to optimize the operation of the refrigerating cycle according to the ratio between the high and low boiling coolants of the actually circulating coolant mixture. This results in saving energy, achieving comfort, and improving performance and reliability.

The control operations (1) to (10) mentioned above are examples and do not limit the present invention. Each of the control examples may be carried out alone or in combination with others. Values after a change are not limited to those shown in FIGS. 5 to 13. A variety of control values may be employed according to the ratio between the high and low boiling coolants of the non-azeotropic coolant mixture. Each control operation may be reversible to return to a basic control operation. The control values may be changed according to various operation modes such as humidification and dehumidification modes of the air conditioner.

The embodiment of FIG. 3 may employ a ratio sensor instead of the level sensor 19. The ratio sensor detects the dielectric constant and temperature of the non-azeotropic coolant mixture and calculates the ratio between the high and low boiling coolants of the mixture. Instead of the electric expansion valve 7, a temperature expansion valve or a capillary tube may be employed.

In summary, the refrigerating cycle according to the present invention changes basic operation parameters according to a change in the ratio between the ingredients of a non-azeotropic coolant mixture sealed in the refrigerating cycle, to stabilize and optimize the operation of the refrigerating cycle irrespective of changes in a cycle temperature or pressure due to the change in the ratio.

Various modifications will become possible for those skilled in the art after receiving the teachings of the present disclosure without departing from the scope thereof.

What is claimed is:

1. An air conditioner, comprising:

(a) a refrigerating cycle including a compressor, an outdoor heat exchanger, an indoor heat exchanger, a throttle mechanism, and coolant piping connecting these components to one another;

(b) a non-azeotropic mixture of high and low boiling coolants sealed in said refrigerating cycle; and (c) a control means for changing basic operation parameters on operation conditions that cause a change in a ratio between the high and low boiling coolants of the coolant mixture according to a change in an opening of said throttle mechanism.

2. The air conditioner according to claim 1, wherein said throttle mechanism comprises an electric expansion valve.

3. The air conditioner according to claim 1, wherein the basic operation parameters changed by said control means include a basic operation frequency of said compressor.

4. The air conditioner according to claim 1, wherein the basic operation parameters changed by said control means include a voltage/frequency (V/F) of said compressor.

5. The air conditioner according to claim 1, wherein one of the basic operation parameters changed by said control means is the basic revolution speed of an indoor fan for sending air to the indoor heat exchanger so that said coolant mixture flowing through the indoor heat exchanger may exchange heat with the air.

6. The air conditioner according to claim 1, wherein one of the basic operation parameters changed by said control means is the basic revolution speed of an outdoor fan for sending air to the outdoor heat exchanger so that said coolant mixture flowing through the outdoor heat exchanger may exchange heat with the air.

7. The air conditioner according to claim 1, wherein one of the basic operation parameters changed by said control means is the basic position of a louver disposed at an air outlet of an indoor unit accommodating the indoor heat exchanger, the louver changing the direction of outgoing air.

8. The air conditioner according to claim 1, wherein one of the basic operation parameters changed by said control means is a basic degree of superheat set by the throttle mechanism.

9. The air conditioner according to claim 1, wherein one of the basic operation parameters changed by said control means is a basic set temperature used for discharge temperature release control for preventing an excessive increase in the temperature of said coolant mixture discharged from the compressor.

10. The air conditioner according to claim 1, wherein one of the basic operation parameters changed by said control means is a basic set temperature used for indoor heat exchanger temperature release control for preventing an excessive increase in the temperature of the indoor heat exchanger during a heating operation in which the indoor heat exchanger serves as a condenser.

11. The air conditioner according to claim 1, wherein one of the basic operation parameters changed by said control means is a basic set current used for current release control for suppressing a current for driving the compressor below a specified value.

12. The air conditioner according to claim 1, wherein one of the basic operation parameters changed by said control means is a basic set temperature for a defrosting operation that is started according to temperatures detected by a temperature sensor provided for the outdoor heat exchanger and an ambient temperature sensor.

13. An air conditioner, comprising:

(a) a refrigerating cycle including a compressor, an outdoor heat exchanger, an indoor heat exchanger, a throttle mechanism, and coolant piping connecting these components to one another;

(b) a non-azeotropic mixture of high and low boiling coolants sealed in said refrigerating cycle;

(c) a ratio detecting means for detecting a ratio between the high and low boiling coolants of the coolant mixture based on a quantity of a liquid phase of the coolant mixture accumulated in said refrigerating cycle during an operation of said refrigerating cycle; and (d) a control means for changing basic operation parameters on operation conditions according to a value detected by said ratio detecting means.

14. The air conditioner according to claim 13, wherein said ratio detecting means includes a level sensor arranged in an accumulator that is disposed in said refrigerating cycle and accumulates the liquid phase of the coolant mixture, said level sensor sensing the quantity of the coolant accumulated in said accumulator.

15. An air conditioner, comprising:

(a) a refrigerating cycle including a compressor, an outdoor heat exchanger, an indoor heat exchanger, a throttle mechanism, and coolant piping connecting these components to one another;

(b) a non-azeotropic mixture of high and low boiling coolants sealed in said refrigerating cycle;

(c) a ratio detecting means for detecting a ratio between the high and low boiling coolants of the coolant mixture during an operation of said refrigerating cycle; and (d) a control means for changing basic operation parameters according to a value detected by said ratio detecting means;

wherein said ratio detecting means includes a level sensor arranged in an accumulator that is disposed in said refrigerating cycle and accumulates the liquid phase of the coolant mixture, said level sensor sensing the quantity of the coolant accumulated in said accumulator.

* * * * *